United States Patent [19]

Tinnis

[11] 4,416,422

[45] Nov. 22, 1983

[54] STEPLESSLY ADJUSTABLE DEVICE FOR INJECTING BLACK LIQUOR INTO A SODA DIGESTER

[75] Inventor: Valentin Tinnis, Espoo, Finland

[73] Assignees: Ekono Oy, Helsinki; A. Ahlstrom Osakeyhtio, Karhula, both of Finland

[21] Appl. No.: 279,691

[22] Filed: Jul. 1, 1981

[51] Int. Cl.[3] ..... B05B 1/32

[52] U.S. Cl. ..... 239/455; 239/540

[58] Field of Search ..... 239/451, 455, 538, 540

[56] References Cited

U.S. PATENT DOCUMENTS

| | | | |
|---|---|---|---|
| 177,239 | 5/1876 | Haley | 239/455 |
| 555,573 | 3/1896 | Haas | 239/538 X |
| 1,543,009 | 6/1925 | Hedges | 239/451 |
| 4,234,128 | 11/1980 | Quinn et al. | 239/538 X |

FOREIGN PATENT DOCUMENTS

| | | |
|---|---|---|
| 484796 | 10/1929 | Fed. Rep. of Germany . |
| 361731 | 11/1974 | Sweden . |

*Primary Examiner*—John J. Love
*Assistant Examiner*—Mary F. McCarthy
*Attorney, Agent, or Firm*—Cushman, Darby & Cushman

[57] ABSTRACT

In a device for adjusting the flow quantity and drop size of black liquor to be injected into a soda digester, an outflow opening with an adjustable cross-sectional area, relatively rotatable coaxial outer and inner pipes, the outer pipe being provided with an end piece covering a part of the outer end of the outer pipe and the inner pipe being provided with a nozzle piece covering a part of the outer end of the inner pipe, the outflow opening being formed by an opening remaining outside the areas covered by the end piece and the nozzle piece.

6 Claims, 2 Drawing Figures

STEPLESSLY ADJUSTABLE DEVICE FOR INJECTING BLACK LIQUOR INTO A SODA DIGESTER

The present invention relates to a device for adjusting the flow quantity and drop size of black liquor to be injected into a soda digester, said device comprising a valve for adjusting a primary pressure of said device, and an outflow opening the cross-sectional area of which is adjustable for adjusting the drop size, an outer pipe and an inner pipe arranged coaxially rotatably inside said outer pipe and provided with openings for providing a flow connection between inner parts of said outer and inner pipes.

Conventional control for injection of black liquor into a soda digester is based on the use of nozzles to be changed according to the load and on the adjustment of the throttle valve of the black liquor injector. Thus, the outflow opening of the nozzle is determined stepwise, corresponding to the required black liquor flow, i.e. the load of the soda boiler, while the primary pressure for the nozzle is adjusted by means of the throttle valve.

In the soda digester furnace the drop size and the size distribution of the injected liquor depend, inter alia, on the temperature and dry content of the black liquor, the pressure difference and flow rate in the nozzle as well as the shape and angle of attack of the diffuser.

If a stepless adjustment of the outflow opening would be possible, one more degree of freedom could be added to the control system whereby the primary pressure in the nozzle could be adjusted by means of the throttle valve and the flow quantity by means of the outflow opening.

The object of the invention is to provide such an advantageous control device, and the invention is based on the following considerations:

Because the drying of black liquor in the soda digester furnace partly is determined by the average drop size of the black liquor, it is desirable to be able to affect the drop size while maintaining the flow of black liquor unchanged.

When using a spoon-like nozzle, the drop size, according to literature date, follows the following dependence:

$$\bar{d}=k(\sigma A/\Delta p)^{\frac{1}{2}} \quad (1)$$

wherein $\bar{d}$=average drop size k=coefficient $\sigma$=surface tension in black liquor A=cross-sectional area of outflow opening $\Delta P$=pressure loss in nozzle.

The following dependence is valid for the flow V of black liquor $$V=(A/\xi)\,(2\Delta p/\rho)^{\frac{1}{2}} \quad (2)$$

wherein $\xi$=flow coefficient $\rho$=density

From the equations (1) and (2) follows that, by manipulating the magnitudes A and $\Delta p$, V can be set to the desired value while keeping $\bar{d}$ unchanged, in other words, if it is assumed that k, $\xi$, $\rho$ and $\sigma$ are constants, then $$A_2=A_1\,(V_2/V_1)^{\frac{2}{3}} \quad (3)$$

$$\Delta P_2=\Delta P_1\,(V_2/V_1)^{\frac{2}{3}} \quad (4)$$

The subindexes 1 and 2 illustrate two conditions 1 and 2, respectively.

If, for example, it is desired to increase the flow 20%, both the outflow opening and pressure difference must be increased 13% in order that the drop size shall remain more or less unchanged.

In a corresponding manner, the drop size can be affected while maintaining the flow at the desired level.

At a constant flow quantity, the average drop size can be adjusted according to formulas (5) and (6) which have been derived from the equations (1) and (2) when k, $\sigma$, $\xi$ and $\rho$ are fixed:

$$A_2=A_1(\bar{d}_2/\bar{d}_1)^{\frac{2}{3}} \quad (5)$$

$$\Delta P_2=\Delta P_1(\bar{d}_1/\bar{d}_2)^{4/5} \quad (6)$$

For example, if it is desired to increase the average drop size 10%, the pressure difference must be reduced about 12% and the outflow opening increased about 6.6%.

The nozzle is dimensioned so that the flow over the entire area of operation is turbulent, i.e. the Reynolds number is >2000.

The device according to the invention is characterized in that the outer end of said outer pipe being provided with an end piece covering a part of the cross-sectional area of the outer end of said outer pipe, which part is asymmetric as to the centre axis of said outer pipe, and the outer end of said inner pipe being provided with a nozzle piece covering a part of the cross-sectional area of the outer end of said inner pipe, which part is asymmetric as to the centre axis of said inner pipe, said outflow opening being formed by an opening which remains entirely free in the outer end of both pipes outside the areas covered by said end piece and said nozzle piece.

By means of the invention prerequisites are provided for a simultaneous adjustment of both the flow and the drop size.

The invention will now be described in more detail by means of an embodiment according to the accompanying drawings.

The primary pressure is adjusted in a conventional manner, for example, by means of a throttle valve 20 (not shown). The outflow opening 1 is adjusted right at the point where black liquor is discharged from the nozzle.

Figure 1:
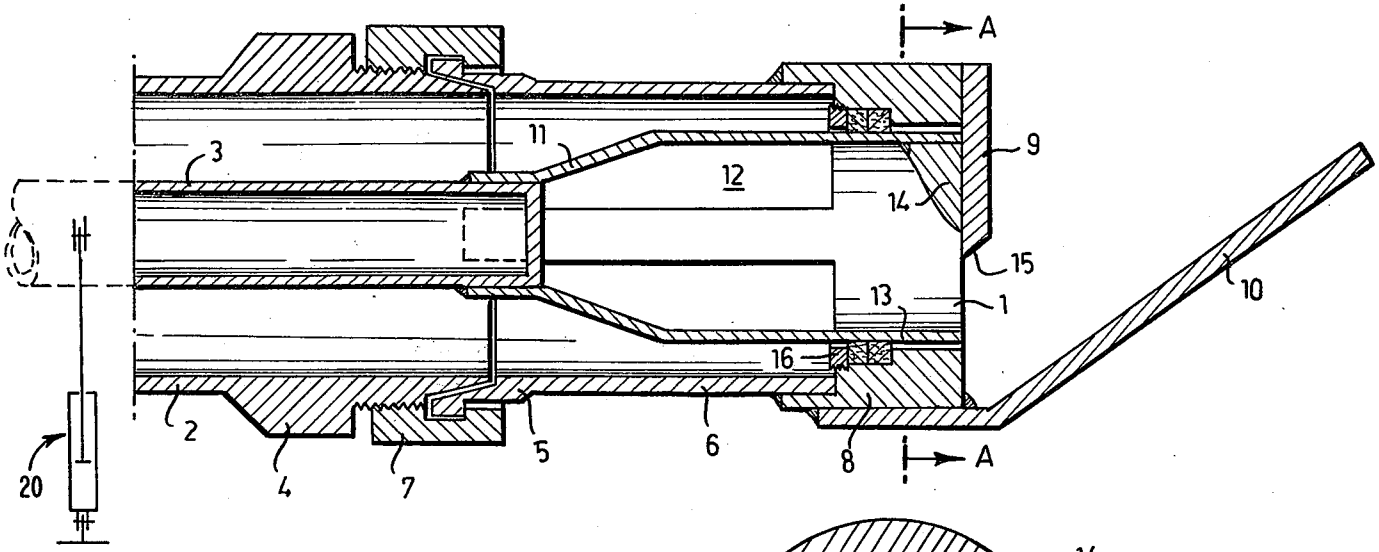
FIG. 1 is a longitudinal section of one nozzle means according to the invention.
Figure 2:
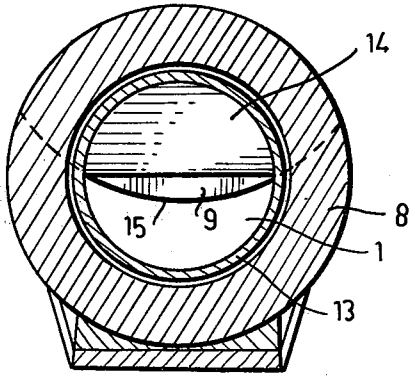
FIG. 2 is a cross-section taken along line A—A in FIG. 1.

The outflow opening 1 of the nozzle (FIG. 1) is steplessly adjusted in the following manner:

The body of the device consists of two pipes 2 and 3 built one within the other. An extension part 6 is connected to the outer pipe 2 through an extension piece 4 and a connection part 5. The connection is joined with a clamping piece 7. To the extension part 6 of the pipe is welded an end ring 8 to which again are welded an end piece 9 and a diffuser plate ("spoon") 10.

To the inner pipe 3 is welded an extension part 11 in which four openings 12 are machined for the flow of black liquor from the interspace defined by the pipes 2 and 3 to the nozzle opening proper. A nozzle piece 14 is welded to an end ring 13 in the extension piece 11.

The inner pipe combination 3,11,13,14 is rotatable about the longitudinal axis of the pipe.

The end piece 9 is shaped so that the cross-sectional area of the outflow opening defined by the curved edge of said end piece, the nozzle piece and the pipe 3 is exponentially dependent on the angle of rotation of the inner pipe. The end piece and the nozzle piece cover parts of respective pipe which are asymmetric as to the centre axis of the pipe.

The nozzle piece 14 is firmly pressed against the end piece 9 under the action of a spring combination (not shown) in one end of the inner pipe 3.

The extension part 11 with the pipe 3 is sealed from the end ring 8 by means of a suitable sealing combination 16.

The flowing medium, i.e. black liquor, functions as cooler for the device itself.

The angle of rotation of the closing part of the device is adjusted by means of a suitable actuating means, for example, a pneumatic actuator positioned in the outer end of the injector.

The adjustable injector can be mounted on a soda digester in a conventional manner by securing it, for example, to the oscillating means of the injector.

What I claim is:

1. A device for adjusting the flow quantity and drop size of black liquor to be injected into a soda digester, said device comprising a valve for adjusting a primary pressure of said device, and an outflow opening the cross-sectional area of which is adjustable for adjusting the drop size, an outer pipe and inner pipe arranged coaxially rotatably inside said outer pipe and provided with openings for providing a flow connection between inner parts of said outer and inner pipes, the outer end of said outer pipe being provided with an end piece covering a part of the cross-sectional area of the outer end of said outer pipe, which part is asymmetric as to the centre axis of said outer pipe, and the outer end of said inner pipe being provided with a nozzle piece covering a part of the cross-sectional area of the outer end of said inner pipe, which part is asymmetric as to the centre axis of said inner pipe, said outflow opening being formed by an opening which remains entirely free in the outer end of both pipes outside the areas covered by said end piece and said nozzle piece.

2. A device as claimed in claim 1, wherein said end piece and said nozzle piece have edges that are shaped so that the cross-sectional area of said outflow opening is exponentially dependent on the angle of rotation of said inner pipe in relation of said outer pipe.

3. A device as claimed in claim 2, wherein said edge of said nozzle piece is located approximately on the diameter of an outer part of said inner pipe.

4. A device as claimed in claim 2, wherein said edge of said end piece is curved.

5. A device as claimed in claim 2, wherein said edges of said end piece and said nozzle piece are in side profile shaped pointed so that the coefficient of resistance changes only slightly as the flow and/or cross-sectional area of said outflow opening changes.

6. A device as claimed in claim 1, wherein said outflow opening is dimensioned so that the outflow over the entire area of operation is turbulent.

* * * * *